US005791553A

United States Patent [19]

Fabel

[11] Patent Number: 5,791,553

[45] Date of Patent: Aug. 11, 1998

[54] LAMINATED MAILER BLANK WITH TRANSPARENT WINDOW

[76] Inventor: Warren M. Fabel, 961 Iris Dr., Delray Beach, Fla. 33431

[21] Appl. No.: 434,416

[22] Filed: May 3, 1995

Related U.S. Application Data

[63] Continuation-in-part of Ser. No. 240,869, May 10, 1994, abandoned, and a continuation-in-part of Ser. No. 349,062, Dec. 1, 1994, abandoned, and a continuation-in-part of Ser. No. 377,126, Jan. 23, 1995, abandoned.

[51] Int. Cl.[6] ..... B65D 27/10

[52] U.S. Cl. ..... 229/92.1; 229/92.3

[58] Field of Search ..... 229/92.1, 92.3, 229/69, 71

[56] References Cited

U.S. PATENT DOCUMENTS

| | | | |
|---|---|---|---|
| 3,370,781 | 2/1968 | Stroge | 229/71 |
| 4,371,489 | 2/1983 | McGrall . | |
| 4,936,769 | 6/1990 | Schoenleber | 229/92.3 |
| 4,951,864 | 8/1990 | Dicker . | |
| 5,294,042 | 3/1994 | Giordano | 229/69 |

*Primary Examiner*—David P. Bryant
*Attorney, Agent, or Firm*—Quarles & Brady

[57] ABSTRACT

A mailer blank, which may be configured for subsequent printing and folding processes, includes a transparent sheet and an attached opaque layer, both of which extend between longitudinal and transverse edges. An aperture is formed within the opaque layer. In a first version, the mailer blank also includes a second opaque layer, having an aperture aligned with the aperture of the first opaque layer, similarly extending between the longitudinal and transverse edges. Both the first and second layers are paper, adhesively attached to opposite sides of the transparent layer. In a second version, the opaque layer is a ultra-violet ink coating. In a third version, a paper layer is attached to one side of the transparent sheet, with a pocket being formed between one of the paper layers and the sheet for use as a return envelope.

20 Claims, 3 Drawing Sheets

LAMINATED MAILER BLANK WITH TRANSPARENT WINDOW

RELATION TO OTHER PATENT APPLICATION

This is a continuation in part of U.S. patent application Ser. No. 08/240,869, filed May 10, 1994, entitled "Mailing Form For Non-Impact Printing", now abandoned, U.S. patent application Ser. No. 08/349,062, filed Dec. 1, 1994, entitled "Transparent Security Pocket Compatible With Non-impact Printers", now abandoned, and U.S. patent application, Ser. No. 08/377,126, filed Jan., 23, 1995, entitled "Multi-Part Non-Impact Printer AirBill Form", now abandoned.

BACKGROUND OF THE INVENTION

1. Field of the Invention

This invention relates to a flat laminated sheet for being folded into a mailer with a transparent window, and more particularly to providing such a sheet in a form which can be fed reliably through printing and folding devices.

2. Description of the Prior Art

A number of different types of mailer blanks are used to provide mailers after suitable printing and folding operations. A typical mailer, after the printing operations are completed, includes at least some variable information, such as the address of the individual to whom the mailer will be sent. The mailer may also have fixed information, which is applied in an identical manner to a large number of mailers. Often, a transparent window is provided on a part of the mailer blank through which a portion of the printed information can be viewed after the printing and folding processes are completed. Such a window is conventionally formed by adhesively attaching a transparent sheet of plastic or cellulose material to extend across an aperture which has been die cut in the sheet of paper forming the mailer blank.

It is often particularly desirable to print the address to which the mailer is being sent, along with other variable information as needed, on a part of the mailer blank which becomes the inside of an envelope structure after the folding processes are completed. By properly aligning the printing, the address information can be read through a transparent window positioned opposite to the address information after folding. In this way, it becomes unnecessary to print variable information on both sides of the mailer blank; rather, all such information is printed on the surface which becomes the inside of the envelope structure, thereby saving a printing step.

For example, when a mailer of the type just described is used to distribute checks, the name and address of the recipient may be visible both as the location to which the mailer is addressed and as the payee of the check. Upon receipt, the envelope is opened and the check portion is separated from the remaining portion of the mailer by tearing along a perforated line. Other variable information, such as the amount of the check and account numbers is printed on the same side of the mailer blank as the check, but is concealed when mailer is folded for mailing.

U.S. Pat. No. 4,951,864 to Dicker describes apparatus a typical prior art mailer blank and the folding and sealing thereof. Dicker's mailer blank includes remoistenable glue strips on the longitudinal sides and one traverse side of the blank, which strips are moistened prior to folding into a mailer envelope. A window aperture shown within the mailer is formed by adhesively attaching a transparent sheet to extend across a rectangular opening in the paper of the mailer. However, the transparent sheet overlaps the opening, being adhesively attached to the paper around the opening, causing the localized increase in thickness.

A particular problem with a conventional mailer blank of the type described above arises as a result of the additional thickness of the transparent sheet used to form the window. A typical mailer blank is made from 0.004 inches thick paper stock and 0.001 inch thick transparent sheet attached by an adhesive around an aperture in the paper stock. Thus, around the edges of the aperture, where the paper stock and the transparent sheet overlap, the thickness of the mailer blank is increased by 0.001 inch, or 25 percent of the paper thickness. Because of this difference in thickness, the mailer blanks do not lie flat when they are stacked for feeding into the apparatus used for the printing and folding apparatus. They further do not lie flat when stored as inventory or shipped from the point of manufacture to the end user's facilities. Even if shims are used in packing, the mailer blanks generally have a permanent curl when they are removed from the cartons in which they are shipped and stored.

Mailers for high volume applications are preferably printed and subsequently folded in high speed devices having an input capacity of, for example, 2000 sheets. However, due to the difference in thickness abound the window aperture, a stack of 2000 sheets of mailer blanks manufactured as described above is typically about twelve inches thick around the aperture and about eight inches thick at locations remote from the aperture, such as the edge of the form being fed into the printing and folding devices. Furthermore, these sheets cannot lie flat an any bin holding them in quantities of about 2000 for feeding into a printing or folding device.

The various mechanisms used to feed sheets one at a time through printing and folding devices are very intolerant of curled sheets, particularly if the curl results in the corners of an individual sheet being raised or lowered with respect to the central part of the sheet. Specifically, the curl prevents individual sheets from being properly separated in the mechanisms designed to separate the sheets so that they can be fed one at a time for printing or folding. Further, the curl causes the corners of the sheets to be caught on various obstructions along the paper feeding path of the printing and folding devices. In this way, failures to feed sheets and various types of paper jams are caused as the equipment is operated.

This problem has become more serious with an increased use of non-impact printers, such as laser printers, to print the variable information on mailers, since such printers require the rapid and reliable feeding of individual sheets of paper into the printing process.

What is needed is a mailer blank having an aperture with a transparent window, without the increased local thickness resulting in paper curl when significant numbers of the blanks forms are stacked.

SUMMARY OF THE INVENTION

In accordance with one aspect of the invention, there is provided a mailer blank having a transparent layer and an opaque layer on one side of said transparent layer. The opaque layer includes an aperture covered by said transparent layer to form a window. Further, the opaque layer and transparent layer are co-extensive outward from the aperture to lateral and transverse edges of the mailer.

BRIEF DESCRIPTION OF THE DRAWINGS

Preferred embodiments of the subject invention are hereafter described with specific reference being made to the following Figures, in which.

DETAILED DESCRIPTION

Figure 1:
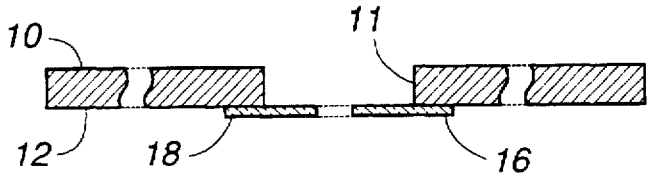
FIG. 1 (PRIOR ART)
FIG. 1 is a fragmentary, transverse elevational view of a prior art mailer blank formed in accordance with a conventional method, taken through a transparent window provided therein.
Figure 2:
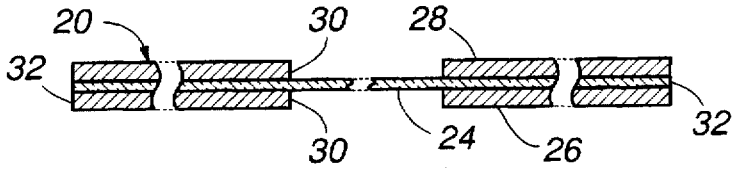
FIG. 2 is a fragmentary, transverse elevational view of a mailer blank formed in accordance with a first version of the present invention, taken through a transparent window provided therein.
Figure 3:
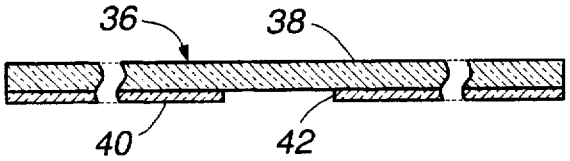
FIG. 3 is a fragmentary, transverse elevational view of a mailer blank formed in accordance with a second version of the present invention, taken through a transparent window provided therein.

Basic differences between a mailer blank constructed according to the prior art and a mailer blank constructed according to the present invention will first be discussed, with references to FIGS. 1–3, each of which is a partial transverse cross-sectional elevation view of a respective mailer blank taken through the window aperture therein. In particular, FIG. 1 illustrates the prior art mailer blank; FIG. 2 illustrates a first embodiment of the present invention; and FIG. 3 illustrates a second embodiment of the present invention.

Referring first to FIG. 1, a typical prior art mailer blank 10 having an aperture window 11 conventionally placed in a sheet 12 of standard paper stock, approximately 0.004 inches in thickness. Aperture 11 is typically formed by die cutting during the manufacture of mailer blank 10. A transparent sheet 16, approximately 0.001 inches in thickness, is attached to cover aperture 11, overlapping in overlap regions 18 extending along each edge of aperture 11. The attachment of transparent sheet 16 is accomplished in overlap regions 18, for example, through the use of an adhesive. Because the thickness of mailer blank 10 in overlap regions 18 includes both the paper thickness, the thickness of the transparent sheet, and the thickness of the adhesive, the total thickness of a stack of 2000 mailers 10 is increased from approximately eight inches to approximately twelve inches between the edges thereof and region 18.

Referring to FIG. 2, a mailer blank 20 fabricated in accordance with a first embodiment of the present invention includes a transparent layer 24, such as a transparent plastic film, laminated between an inner layer 26 of paper stock and an outer layer 28 of paper stock. The designations of "outer" and "inner" are included at this point to indicate the paper layer which will form the outer surface of an envelope, when mailer blank 20 is subsequently folded, from the paper layer which will form the inner surface of the envelope. Each paper layer 26 and 28 includes an aperture 30, which may be formed using conventional die cutting techniques during the manufacture of mailer blank 20. The two apertures 30 are aligned so that, when mailer blank 20 is folded into a pre-defined shape for mailing, visible information can be viewed through apertures 30 and transparent layer 24.

Since transparent layer 24 extends to the edges 32 of mailer blank 20, the thickness of mailer blank 20 is uniform across its entire surface. The uniform thickness is also achieved even if transparent layer 24 slightly overextends or underextends paper stock layers 26 and 28. It should be noted that the reduction in thickness caused by the elimination of the paper within apertures 30 does not effect the ability of a stack of mailer 20 to be stacked evenly and fed through printing and folding equipment. The thicknesses of both transparent layer 24 and paper layers 26 and 28 are determined to provide suitable stiffness to allow reliable processing through printing and folding operations, as well as to be within the regulations of the U.S. Postal Service for automatic handling of envelopes. Preferably, each of paper layers 26 and 28 has a thickness of about 0.0025 inches, while transparent layer 24 has a thickness of about 0.001 inches.

Alternatively, one of paper layer 26 or 28 may be eliminated in FIG. 2, in which case the thickness of the remaining paper layer should be 0.004 inches.

Referring now to FIG. 3, a mailer blank 36, fabricated as a second embodiment of the present invention, is formed using a transparent layer 38 having a side on which an opaque layer 40 is coated. Opaque layer 40 preferably is a ultra-violet rotary screen ink material having a white or pastel color appearance, and having appropriate chemical and physical properties allowing the application thereto of inks and toners by conventional printing processes. It should be noted that opaque layer 40 may be coated on both sides of transparent layer 38 so that mailer 20 resembles the appearance of conventional paper.

An aperture 42 is formed by leaving an open area in opaque layer 40. Again, the increased thickness caused by the overlap condition of the prior art mailer blank 10 (shown in FIG. 1) does not occur, so large numbers of mailer blanks 36 may be stacked for shipping, storage, and, in hoppers for being fed individually into printing and folding devices. To provide suitable stiffness for use as a mailer, the thickness of transparent layer 38 is preferably increased into the range of 0.003 to 0.005 inches.

Alternately, a mailer blank of the type described with respect to FIGS. 2 or 3 may be made using a paper layer 26 laminated to a one side of transparent layer 24 or 38, with the opposite side of transparent 24 or 38 being coated with opaque layer 40. In this case, the thickness of transparent layer 24 or 38 would be 0.001 inches.

Referring to FIGS. 2 and 3, transparent layers 24 and 38 are preferably composed of materials capable of passing through the thermal fusing station of a typical laser printer with minimal dimensional changes and curling. A suitable material for these applications is polyethylene terephthalate film. The application of opaque coating 40 is facilitated by applying an anti-static or priming layer to the transparent film layers 24 or 38. A suitable process for applying an anti-static layer is described in U.S. Pat. No. 4,371,489 to McGrail. Depending on the adhesive process used to form the laminations of FIG. 2, this type of coating may also be used to prepare transparent layer 24 for lamination. It should further be noted that the thickness of transparent layer 38 may vary between 0.0005 and 0.00125 inches, with 0.001 inches being a preferred thickness for the first embodiment, as described above with respect to FIG. 2 and 0.003–0.005 inches being the preferred thickness for the second embodiment, as described above with respect to FIG. 3.

One preferred type of material that may be used for transparent layers 24 and 40 is Melinex 1311, one distributor of which is Plastic Suppliers, 1174 Hayes Industrial Drive, Marrietta, Ga. 35062. Melinex 1311 is a clear film with anti-static properties on both surfaces of its web. Its surface resistivity, independent of gauge, is $2\times10^{10}$ ohms/square, which overcomes the static electricity and laser corona based problems which generally prevent stacks of plastic films from being used with laser printers. Moreover, Melinex 1311 film does not suffer from unacceptable shrinkage, when passed through the high heat of the fusing stage of a laser printer. Melinex 1311 polyester film is described in more detail in U.S. Pat. No. 4,371,489 in the name of Patrick T. McGrall and entitled "Production of Anti-static Thermoplastic Films". Additional problems encouraging the use of Melinex 1311 film are discussed in my co-pending patent application, Ser. No. 08/394,062, filed Dec. 1, 1994 and entitled "Transparent Security Pocket Compatible With Non-impact Printers". Melinex 1311, or its equivalent without the anti-static coating, may be used as the transparent layer where paper covers substantially both sides of the transparent plastic film, such as shown in FIG. 2.

Figure 4:
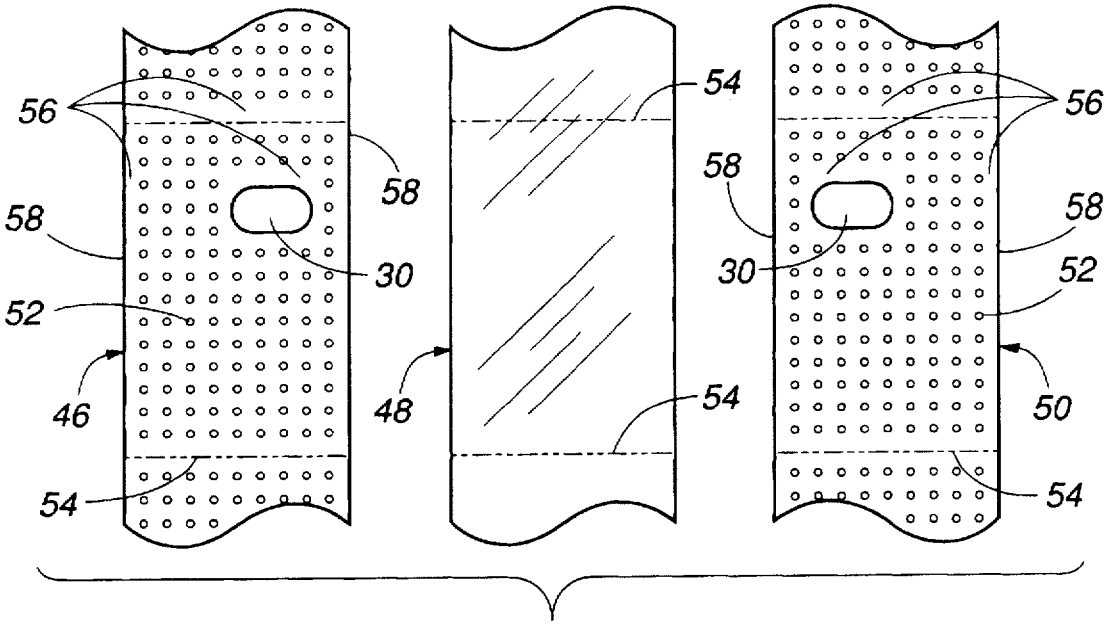
FIG. 4 is a fragmentary plan view of two paper webs and of a transparent web which are laminated together and cut to length to form the mailer blank of FIG. 2.

Referring now to FIG. 4, a plan view is shown of two paper webs 46 and 50 and one transparent web 48. These three webs 46, 48 and 50 are laminated together and cut to length to form mailer blank 20 shown in FIG. 2. More specifically, inner paper web 46 forms inner paper layer 26, transparent web 48 forms transparent layer 24, and an outer paper web 50 forms outer paper layer 28. Preferably, each paper web 46 and 50 is imprinted with a fine array of adhesive dots 52 on surface 54 to be applied against transparent web 48. In order to avoid cluttering, a relatively course array of dots 52 is shown for illustrative purposes in FIG. 4. Dots 52, for example, are formed of a pressure sensitive adhesive applied using either a screen printing process or a flexographic printing process. Applying adhesive dots 52 in this manner minimizes the bulk of the adhesive, while providing a desirable type of flexibility in mailer blank 20 at a cost effective price.

In FIG. 4, paper layers 46 and 50 are oriented to show adhesive dots 52, that is, both paper layers 46 and 50 are transversely displaced from transparent web 48, and inner paper web 46 is shown as being inverted from the orientation it has when laminated to transparent web 48. In the lamination process, outer layer 50 is applied, with pressure exerted between nip rollers (not shown), to a first side of transparent web 48, and inner layer 46 is applied, also with pressure exerted between nip rollers (not shown) to the side of transparent web 48 opposite the first side. Each paper web 46 and 50 includes a number of apertures 30, which are arranged so that apertures 30 of outer web 46 individually align with the apertures 30 of inner web 50 following the lamination process.

Continuing to refer to FIGS. 2 and 4, the laminated web formed by laminating paper webs 46 and 50 to transparent web 48 is subsequently cut into suitable lengths, each such length to be use as a mailer blank 20. In FIG. 4, the location of the cuts between adjacent mailer blanks is indicated by lines 54. Conventional electronic registration or a pattern pre-printed on the non-adhesive coated surface of one of the paper webs 46 or 50 may be used for determining the location of each of the apertures 30 and cuts 54. Various perforations and/or cuts through one or both paper layers may also be made on the laminated web at appropriate locations prior to making each cut 54 to separate the web into mailer blanks 20. As described hereafter, these additional perforations and cuts facilitate the subsequent folding and/or use of each mailer blank 20 into an envelope configuration.

Adhesive dots 52 are preferably arranged in a pattern which provides gaps 56, in which adhesive dots 52 are not applied to paper webs 46 and 50. Gaps 56, for example, are placed along the outer edges 58 of the webs, around apertures 30, and along the locations, indicated by lines 54, where the web will be cut into suitable lengths. Gaps 56 prevent the outward flow of adhesive during the subsequent movement of mailer blank 20 through the heat and pressure fusing station of a laser printer which may subsequently be used to print information on mailer blank 20. A gap width from an adjacent edge of 0.020 to 0.125 inches is preferably used for this purpose, depending on the type and quantity of adhesive used in the lamination process. Without gaps 56, adhesive material could be squeezed out of mailer blanks 20 and accumulate in the fusing station of the printer, resulting in the contamination of the printer. A similar gap for the adhesive dots 52 may also be placed around apertures 30.

Figure 5:
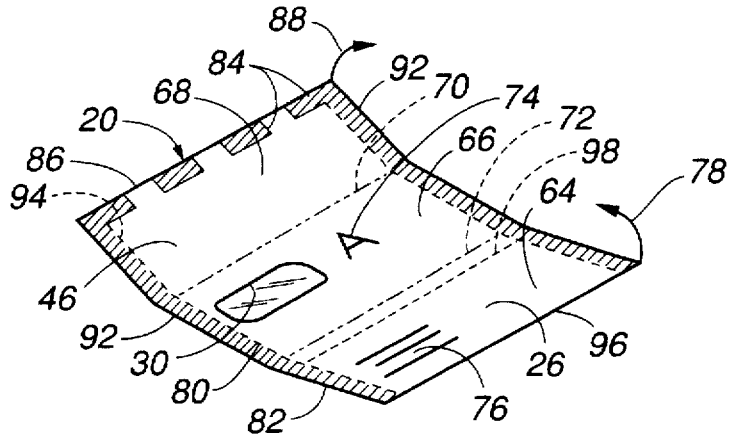
FIG. 5 is an isometric view of a mailer formed from the mailer blank of FIG. 2, shown after printing.

Referring now to FIG. 5, an isometric view of a mailer formed from mailer blank 20 is shown in a state following the printing and lamination. The reference numerals used in FIGS. 2 and 4 are also used to indicate like features in FIG. 5. In FIG. 5, mailer 20 includes a lower portion 64, a central portion 66, and an upper portion 68. Central portion 66 may be separated from upper portion 68 by an upper fold line 70, and from lower portion 64 by a lower fold line 72. Fold lines 70 and 72 may be perforated or compressed lines formed during the manufacture of mailer blank 20 after the lamination, as shown and described with respect to FIG. 4, or they may merely be the fold lines resulting from the operation of folding devices into which mailer blank 20 is to be subsequently fed.

Both fixed information, which does not vary from one mailer 20 to another during the preparation of a batch of mailers 20, and variable information, which does vary from one mailer 20 to another, are printed on inner paper layer 26 formed as a part of web 46. The variable information includes at least a name and address, which is to be printed in area 76 and oriented to be visible through aperture 30 when mailer 20 is folded along lower fold line 72 in the direction indicated by arrow 78. Thus, the printed information should be oriented as indicated by the orientation of the letter "A" 74 in FIG. 5. Variable information is expected to be printed using a simplex non-impact printer, such as a laser printer or an ink jet printer, whereas fixed information can be printed using the same non-impact printer, or it may be pre-printed during or after the manufacture of mailer 20 by normal commercial printing processes. Where the fixed and variable information are printed together, they may be printed during a single pass through the non-impact printer, as all necessary information need only be printed on inner paper layer 26.

Where fixed information is pre-printed, colors and patterns not readily available using a non-impact printer may be included on form 20 and printing can occur on both inner layer 26 and outer layer 28. For example, the pre-printing may even occur on one or both of paper webs 46 and 50 (on the side opposite to the side on which adhesive dots 52 are placed) prior to applying adhesive dots 52 and laminating webs 46 and 50 to transparent web 48, as seen in FIG. 4.

Mailer 20 also includes an adhesive strip 80 extending adjacent to each lateral edge 82 and a segmented adhesive strip 84 extending adjacent an upper transverse edge 86. In FIG. 5, adhesive strips 80 and 84 are indicated by cross-hatching. While strip 80 is shown as solid, it is understood that it also can be broken into non-continuous segments or otherwise patterned to control the amount of adhesive applied. Adhesive strips 80 and 84 are preferably composed of a material which can pass through the various processing stations of a non-impact printer, including the fusing station, without adverse effects. For example, the material forming adhesive strips 80 and 84 may be a microencapsulated adhesive or a remoistenable adhesive. In addition, during the manufacture of mailer 20, suitable longitudinal perforated lines 94 may be formed along the inner boundary of adhesive strip 80, in order to permit mailer 20 to be opened by the recipient.

Figure 6:
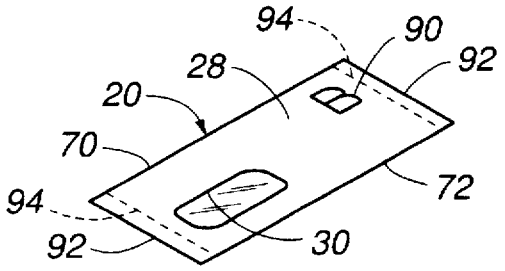
FIG. 6 is an isometric view of the mailer of FIG. 5, shown after folding and adhesive sealing.

Mailer 20 is prepared for mailing by folding first along lower fold line 72, in the direction of arrow 78, and then along upper fold line 70, in the direction of arrow 88. Pressure, or a combination of pressure and moisture is applied to the adhesive strips 80 and 84 to seal mailer 20 in its folded condition, as seen in FIG. 6. A number of commercially available devices, well known in the art of producing mailers for distribution, may be used to facilitate both the folding operation and the activation of adhesive strips 80 and 84 through pressure or through a combination of moisture and pressure. U.S. Pat. No. 4,951,864 to Dicker describes both an adhesive system and a folding and sealing device which can be used for this purpose.

Referring now additionally to FIG. 6, there is shown an isometric view of mailer blank 20 after the folding and adhesive sealing thereof. Fixed information is imprinted on outer paper layer 28, oriented as indicated by the letter "B" 90, to provide, for example, a return address, bulk mail permit information, and opening information. Alternatively, a second window may be included in mailer blank 20 for showing a return address printed on inner paper layer 26.

When mailer 20 is received, it is opened by tearing away ends 92, which have been affixed together through the use of longitudinally extending adhesive strips 80. Separable perforated lines 94 provided during the manufacture of mailer blank 20 facilitate opening. Next, the transversely extending adhesive strip 84 is pulled away from the portion of outer paper layer 28 to which it is attached. Mailer 20 is then opened by unfolding outward along upper fold line 70, in the direction opposite to arrow 88, and by folding outward along lower fold line 72, in the direction opposite to arrow 78.

Mailer 20 may include a portion 96 which is separable from the remainder of mailer 20 along a perforated tear line 98, which also is formed during the manufacture of mailer blank 20. For example, this separable portion 96 may be a check having the name and address of the payee printed in address field 76.

Figure 7:
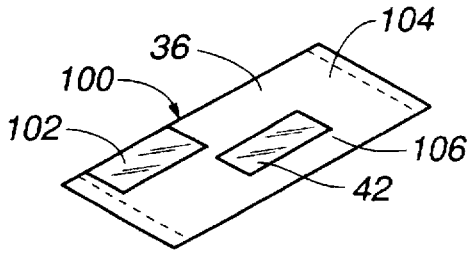
FIG. 7 is an isometric view of a mailer formed from the mailer blank of FIG. 3, shown folding and adhesive sealing.

Referring again to FIG. 3, a mailer blank 36, composed of a thicker transparent plastic film layer 38 having an opaque coating 40, may be perforated and folded as described with respect to FIGS. 5 and 6, resulting in a finished appearance as shown in FIG. 7. A number of printing processes, including the electro-photographic processes of laser printers, may be used to apply printed images to transparent plastic surfaces. Primer coats of various types, or the anti-static coating process described in U.S. Pat. No. 4,371,489 may be used to improve various aspects of this printing process. Alternately, opaque coating 40 may be applied to both sides of transparent layer 38, with apertures aligned in each of the opaque coatings 40, generally as shown in FIG. 2.

Referring now to FIG. 7, there is shown a perspective view of a mailer 100 formed from mailer blank 36 (as shown in FIG. 3), having opaque coating 40 on the inner surface of the envelope and a pair of windows 42 and 102. Specifically, window 102 is provided to facilitate printing the return address on the inner side of mailer 100 together with the addressee's address, which is seen through window 42, as previously explained. Where the transparent plastic film is a transparent polyester film, such as Melinex 1311, fixed information, such as bulk permit information, can be pre-printed on the outer surface 28 thereof.

Figure 8:
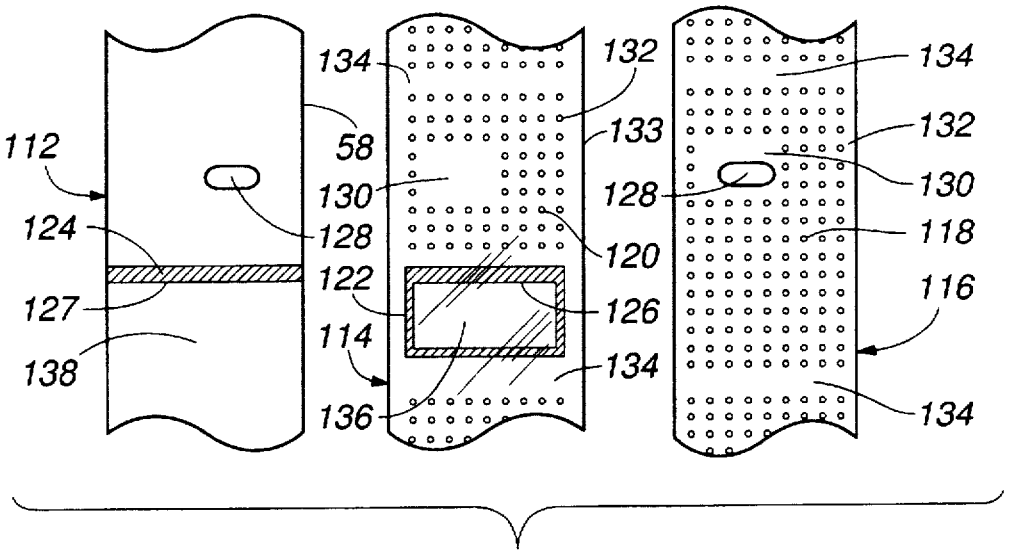
FIG. 8 is a fragmentary plan view of two paper webs, and of a transparent web, which are laminated together and cut to length to form a mailer blank in accordance with a third version of the present invention.
Figure 9:
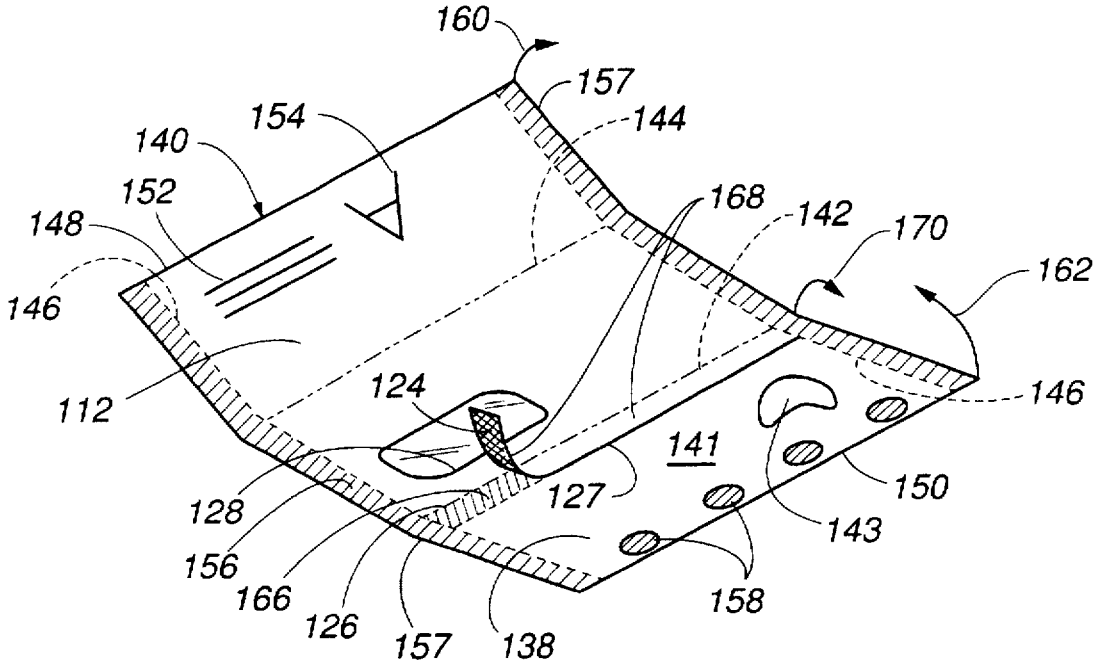
FIG. 9 is an isometric view of a mailer formed from the webs of FIG. 8, shown after printing.

Referring now to FIGS. 8 and 9, there is shown a third embodiment of the present invention, in which an integral envelope 141 is included with a mailer blank 140. Mailer blank 140 provides integral second envelope 141, which can be used by the recipient of mailer 140 to return a document to the original sender of mailer 140. A typical application for mailer 140 is to send a statement in the expectation that a check will be returned in integral second envelope 141. Generally, FIG. 8 shows a fragmentary plan view of two paper webs 112 and 116 and a transparent web 114, which are laminated together and cut to length to form mailer blank 140 and FIG. 9 shows an isometric view of mailer blank 140, formed from webs 112, 114 and 116, in a condition after manufacture and printing and before folding and adhesive fastening.

Referring specifically to FIG. 8, inner paper web 112 is laminated to an upper surface of transparent web 114, and outer paper web 116 is laminated to a lower surface of transparent web 114. Inner paper web 112 subsequently forms an inner surface of mailer blank 140, while outer paper web 116 subsequently forms an outer surface of mailer blank 140. On the surface of outer paper web 116, adjacent to transparent web 114, is a repeating array pattern of adhesive dots 118. As in FIG. 4, a relatively course array is shown for illustrative purposes. Transparent web 114 similarly has a repeating array pattern of adhesive dots 120, together with a hollow rectangular pattern 122, around which adhesive 126 has been applied in a continuous or more dense manner. Inner paper web 112 has a strip of release agent 124 coated thereon in a position to prevent its permanent adhesion to transverse adhesive strip 126. Adjacent to one edge of release agent 124 on inner paper web 112 is a slit tear line 127, which is formed after the lamination of webs 112, 114 and 116. To show the pattern of a release agent 124 in FIG. 8, inner paper web 112 is inverted from the orientation it must assume when it is laminated to transparent web 114.

In addition, apertures 128 are cut in each of paper webs 112 and 116 similar to apertures 30 in FIG. 4. Further, various clear areas 130, 132, 134, where no adhesive dots 120 are present are placed on webs 114 and 116. More specifically, clear area 130 is placed to be in alignment with apertures 128, clear area 132 is placed along the longitudinal edges 133 of webs 114 and 116, clear area 134 is placed where transverse cuts will subsequently be placed to separate individual forms to be made from laminated webs 112, 114 and 116.

In the process of laminating webs 112, 114, and 116, apertures 128 in paper webs 112 and 116 are aligned with one another and with clear area 130 in transparent web 114. At the same time, release agent 124 is aligned with transverse adhesive strip 126. Paper web 112 is generally attached to transparent web 114, through the array of adhesive dots 120, except in clear areas 130, 132 and 134 and in rectangular area 136 surrounded by hollow rectangular adhesive pattern 122. Paper web 116 is generally attached to transparent web 114, except for similarly clear areas 130, 132, and 134. As previously described with to FIG. 4, keeping adhesive dots 120 away from edges 133 of mailer blank 140 prevents the contamination which could otherwise result from the outward squeezing of adhesive 120 as mailer blank 140 passes through the fusing station of a laser printer.

A portion 138 of inner paper web 112 is not laminated directly to transparent web 114 in the area adjacent to clear area 136 and is subsequently used in the formation of integral second envelope 141. Because portion 138 is thus not supported by direct lamination to transparent web 114, the overall thickness of inner paper web 112 is about 0.003 to 0.004 inches, while the thickness of outer paper web 118 is preferably held at about 0.0025 inches.

Referring to FIGS. 8 and 9, after the lamination process, a number of perforations are cut to extend through all three layers 112, 114, and 116. More specifically, a transverse perforated tear line 142, and two longitudinal perforated tear lines 146 are placed on mailer blank 140. In addition, transverse slit tear line 127 is cut through layer 112 only. Optionally, a perforated transverse fold line 144 may be cut, particularly if it is desired that the recipient be able to remove a portion of mailer 140 and return it in envelope 141. The laminated web is then cut to length, forming an upper transverse edge 148 and a lower transverse edge 150. Variable data is printed in an address field 152, being oriented as indicated by the letter "A" 154. Fixed data, and additional variable data, is printed in other areas as desired. As previously described with respect to FIG. 5, an adhesive layer 156 is coated along each longitudinal edge 157, and a series of adhesive dots 158 is placed along lower transverse edge 150.

The process of using mailer 140 begins with folding mailer 140 along fold line 144 in the direction of arrow 160, so that address field 152 becomes visible through aperture 128. Next, mailer 140 is folded along perforated line 142, in the direction of arrow 162. Adhesive coatings 156 and 158 hold mailer 140 in its folded shape. As previously described with respect to FIG. 5, a number of well known, commercially available document folding devices can be used to assist in the folding and gluing of mailer 140.

After receipt, the recipient opens mailer 140 by separating it along longitudinal tear lines 146 and by prying transverse adhesive dots 158 away from their attachment to outer layer 116 near fold line 144. At this point, mailer 140 appears as seen in FIG. 9, but without the side strips below adhesive layer 156 and further without adhesive dots 158. Next, mailer 140 is separated along tear line 142, thereby exposing the interior pocket 143 of envelope 141 formed between inner paper layer 112 and transparent layer 114. In FIG. 9, inner paper layer 112 is shown as partly cut away to show the interior pocket 143. The limits of pocket 143 are defined by adhesive pattern 126, as inner paper layer 112 in lower portion 138 is not directly attached to the adjacent clear portion 136 of transparent layer 114.

Envelope 141 may be used to return an item, such as a check and/or the portion of mailer 140 between perforated line 144 and edge 148, to the organization originally sending mailer 140. After envelope 141 is removed from the remainder of mailer 140 along perforated tear line 142, a closure flap 166, having a tear strip 168 thereon, extends between transverse tear lines 142 and 127 and separates pocket 143 from the edge of envelope 141. At this point, the check, or other item to be returned to the sender of mailer 140, is inserted into pocket 143 and tear strip 168 is removed, exposing adhesive 126, as seen in FIG. 9. On the bottom of tear strip 168, release material 124 is also removed, as it is in a weak contact with adhesive 126. Finally, flap 166 is folded over in the direction of arrow 170 and seals envelope 141 for mailing.

Figure 10:
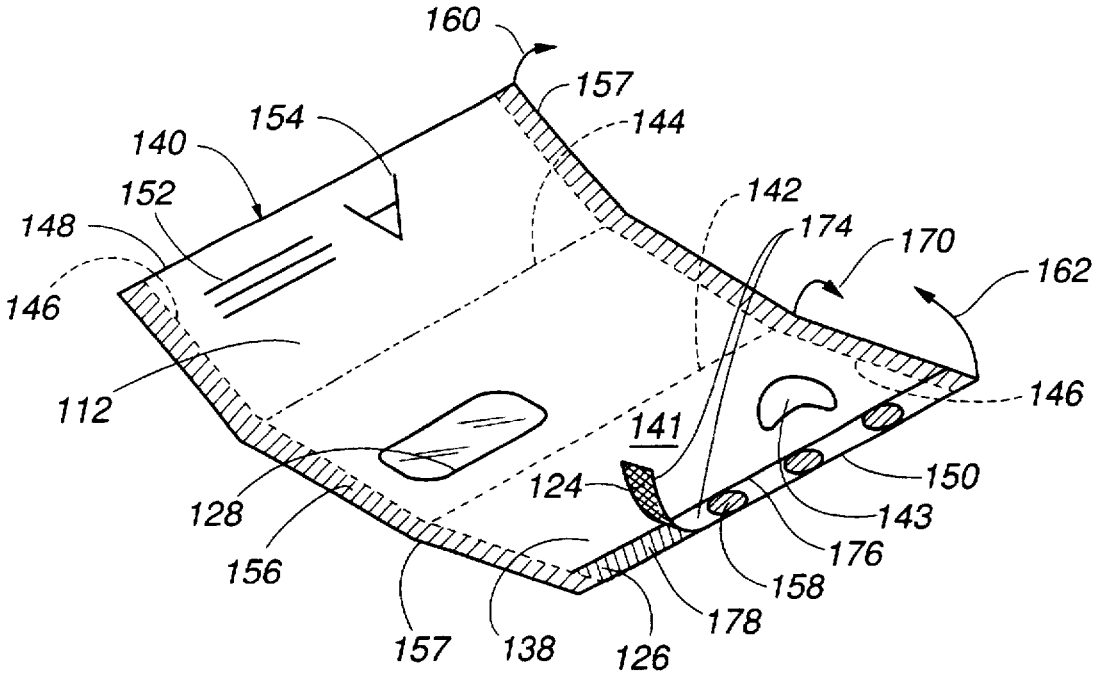
FIG. 10 is an isometric view of an alternate version of the mailer shown in FIG. 9.

Referring now to FIG. 10, an alternate version 172 of mailer blank 140 is shown in which the tear strip 174 and closure flap 178 are placed along the edge 150 instead of along perforated fold line 142. In FIG. 10, like numerical designations are used for similar components shown in FIG. 9. The changes between mailer 140 and mailer 172 are that slit tear line 127 is replaced by slit tear line 176 defining closure flap 178 as being between line 178 and edge 150. Adhesive dots 158 are then placed over tear strip 174 and are removed when tear strip 174 is peeled away. With this change, the adhesive dots 158 do not remain on the return envelope 141 after it is sealed. Further, adhesive 126 in FIG. 8 needs to be rotated 180 degrees and release layer 124 in FIG. 8 needs to be moved downward from the positions shown.

While the above discussion with respect to FIGS. 4 and 8, has described mailer blanks 20 and 140 formed by cutting webs made by laminating paper and transparent layers, which are subsequently cut into suitable lengths, it is understood that similar results, within the scope of the present invention, can be obtained by laminating individual sheets, already cut to the length of mailer blanks 20 and 140, of paper and transparent layers. Further, while the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A mailer blank, comprising a transparent layer;

an opaque layer on one side of said transparent layer, said opaque layer including an aperture covered by said transparent layer to form a window;

said opaque layer and said transparent layer being coextensive and extending outwardly from said aperture to respective lateral and transverse edges which together define lateral and transverse edges of said mailer blank; and, at least one transverse fold line parallel to and remote from said transverse edges of said mailer blank.

2. The mailer blank of claim 1, wherein said opaque layer comprises a paper material layer adhesively attached to said transparent layer and said transparent layer comprises a plastic film material which is shrink resistant at temperatures used to fuse toner to paper in a laser printer.

3. The mailer of claim 2, further comprising a strip of adhesive placed over said opaque layer along at least a portion of said lateral and transverse edges of said opaque layer.

4. The mailer blank of claim 1, wherein said opaque layer is a paper material attached to said transparent layer by means of an adhesive pattern aligned with said aperture, there being a gap in said adhesive pattern forming a pocket between said opaque layer and said transparent layer when said opaque layer is attached to said transparent layer.

5. The mailer blank of claim 4, further including a perforated tear line extending across said mailer blank for separating a portion of said mailer blank, including said pocket, from a remaining portion of said mailer blank.

6. The mailer of claim 4 further including at least one transverse fold line parallel to and remote from said transverse edges, and a strip of adhesive placed over said opaque layer along at least a portion of said lateral and transverse edges.

7. The mailer blank of claim 1, wherein said opaque layer is a coated material adhering to said one side of said transparent layer.

8. A mailer blank comprising:

a transparent layer;

a first opaque layer on a first side of said transparent layer, said opaque layer having an aperture covered by said transparent layer to form a window;

said first opaque layer and said transparent layer being coextensive and extending outwardly from said aperture to respective lateral and transverse edges which together define lateral and transverse edges of said mailer blank; and, a second opaque layer on a second side of said transparent layer opposite said first side, said second opaque layer having a second aperture aligned with said first aperture, said second opaque layer and said transparent layer being coextensive and said second opaque layer extending outwardly from said second aperture to said lateral and transverse edges of said transparent layer, said first opaque layer and said mailer blank.

9. The mailer blank of claim 8, wherein:

said first opaque layer is attached to said transparent layer by a first adhesive pattern from a first aperture gap, surrounding said first aperture, to a first edge gap extending inward from said lateral and transverse edges of said first opaque layer; and, said second opaque layer is attached to said transparent layer by a second adhesive pattern from a second aperture gap, surrounding said second aperture, to a second edge gap extending inward from said lateral and transverse edges of said second opaque layer.

10. The mailer blank of claim 9, wherein:

said first and second aperture gaps extend outward between approximately 0.020 and 0.125 inch from said respective first and second apertures; and, said first and second edge gaps extend inward between approximately 0.020 and 0.125 inch from said respective lateral and transverse edges of said first and second opaque layers.

11. The mailer blank of claim 9, wherein said first and second opaque layers comprise paper having a thickness of approximately 0.0025 inch thick, and wherein said transparent sheet comprises a plastic film material which is shrink resistant at temperatures used to fuse toner to paper in a laser printer, said plastic film having a thickness of between approximately 0.0005 and 0.00125 inches.

12. The mailer blank of claim 8, further comprising:

at least one transverse fold line parallel to and remote from said transverse edges; and, a strip of adhesive placed over at least one of said opaque layers along at least a portion of said lateral and transverse edges.

13. A mailer blank, comprising:

a transparent layer;

a first opaque layer on a first side of said transparent layer, said opaque layer having an aperture covered by said transparent layer to form a window;

said first opaque layer and said transparent layer being coextensive and extending outwardly from said aperture to respective lateral and transverse edges which together define lateral and transverse edges of said mailer blank;

said opaque layer being attached to said transparent layer by an adhesive in a pattern aligned with said aperture, said adhesive pattern having a gap forming a pocket between said opaque layer and said transparent layer;

a perforated tear line extending across said mailer blank for separating a portion of said mailer blank including said pocket from a remaining portion of said mailer blank;

a slit line between said perforated tear line and said pocket, said pocket being accessible at said slit line; and, a release layer between said adhesive layer and said transparent layer in an area between said perforated line and said slit line, whereby said opaque layer is removable from said transparent layer in said area between said perforated line and said slit line and a closure flap remains for sealing said pocket.

14. The mailer blank of claim 13, wherein:

said opaque layer is between approximately 0.003 and 0.005 inches thick; and, said transparent layer comprises a plastic material which is shrink resistant at temperatures used to fuse toner to paper in a laser printer, said plastic film having a thickness of between approximately 0.0005 and 0.00125 inches.

15. A mailer blank, comprising:

a transparent layer;

a first opaque coating on a first side of said transparent layer, said opaque coating having an aperture covered by said transparent layer to form a window;

said first opaque coating and said transparent layer being coextensive and extending outwardly from said aperture to respective lateral and transverse edges which together define lateral and transverse edges of said mailer blank; and, a second opaque coating on a second side of said transparent layer opposite said first side, said second opaque coating having a second aperture aligned with said first aperture and otherwise being coextensive outward from said second aperture to said lateral and transverse edges of said transparent layer.

16. A window mailer form of a type compatible with having information printed thereon by a simplex, non-impact printing device, said window mailer form comprising:

a rectangular transparent layer extending outward to a pair of parallel lateral edges and a pair of parallel transverse edges;

an opaque layer attached to one side of said transparent layer, said opaque layer being co-extensive with said transparent sheet and extending outward to said lateral and transverse edges;

a first aperture within said first opaque layer;

at least one line parallel to one of said transverse and lateral edge pairs about which said window mailer form is to be folded so that said opaque layer of a first portion of said window mailer form is juxtaposed to said opaque layer of a second portion of said window mailer form, whereby selected information printed on said opaque layer of said window mailer form can be viewed through said aperture when said window mailer form is folded; and, means for affixing said opaque layer of said first portion of said window mailer form to said opaque layer of said second portion of said window mailer form.

17. The window mailer form of claim 16, wherein said opaque layer comprises a sheet of paper and said transparent layer comprises a plastic film material which is shrink resistant at temperatures used to fuse toner to paper in a laser printer.

18. The window mailer form of claim 17, comprising:

said at least one line being a perforated line a slit line parallel to said perforated line and defining a third portion of said window mailer form adjacent to said second portion of said window mailer form and remote from said first portion of said window mailer form, and, a pocket formed within said third portion of said window mailer form between facing portions of said opaque layer and said transparent layer.

19. The window mailer form of claim 18, further comprising a flap for sealing said pocket, said flap extending between said perforated line and said slit line, said flap including an adhesive coating affixed to said transparent layer between said perforated line and said slit line, said flap further including a release agent affixed to said opaque layer between said perforated line and said slit line.

20. The window mailer form of claim 16, further comprising:

a second opaque layer, attached to a second side of said transparent layer, said second opaque layer being co-extensive with said transparent sheet and extending outward to said lateral and transverse edges; and, a second aperture within said second opaque layer aligned with said first aperture.

* * * * *

UNITED STATES PATENT AND TRADEMARK OFFICE

CERTIFICATE OF CORRECTION

PATENT NO. : 5,791,553

DATED : August 11, 1998

INVENTOR(S) : Fabel

It is certified that error appears in the above-indentified patent and that said Letters Patent is hereby corrected as shown below:

Title page, item [63] should read:
Continuation-in-part of Ser. No. 240,869, May 10, 1994, abandoned, and a continuation-in-part of Ser. No. 349,062, Dec. 1, 1994, and a continuation-in-part of Ser. No. 377,126, Jan. 23, 1995.

Column 1, line 7, delete "now abandoned"
line 1, delete "now abandoned"
line 12, delete "now abandoned"

Signed and Sealed this

Ninth Day of March, 1999

*Attest:*

Q. TODD DICKINSON

*Attesting Officer*

*Acting Commissioner of Patents and Trademarks*